US009004558B2

(12) United States Patent
Ohlson et al.

(10) Patent No.: US 9,004,558 B2
(45) Date of Patent: Apr. 14, 2015

(54) MOBILE TRANSPORT CONTAINER FOR HANDLING OF DETONATION-DANGEROUS OBJECTS AND METHOD FOR THIS SAME

(75) Inventors: Johnny Ohlson, Kil (SE); Eric Ohlson, Hammarö (SE); Willy Wilhelmsson, Karlskoga (SE)

(73) Assignee: Dynasafe International AB, Stockholm (SE)

( * ) Notice: Subject to any disclaimer, the term of this patent is extended or adjusted under 35 U.S.C. 154(b) by 0 days.

(21) Appl. No.: 14/006,543

(22) PCT Filed: Mar. 21, 2012

(86) PCT No.: PCT/SE2012/000038

§ 371 (c)(1),
(2), (4) Date: Dec. 6, 2013

(87) PCT Pub. No.: WO2012/128691

PCT Pub. Date: Sep. 27, 2013

(65) Prior Publication Data

US 2014/0083899 A1 Mar. 27, 2014

(30) Foreign Application Priority Data

Mar. 22, 2011 (SE) ..... 1100207

(51) Int. Cl.
*F42D 5/045* (2006.01)
*F42B 39/30* (2006.01)
(Continued)

(52) U.S. Cl.
CPC ..... *F42B 39/30* (2013.01); *F41H 11/28* (2013.01); *F42B 39/14* (2013.01); *F42D 5/045* (2013.01); *B66C 3/04* (2013.01); *B66C 3/16* (2013.01); *B66C 3/18* (2013.01)

(58) Field of Classification Search
CPC ..... F42D 5/045; F42B 39/30; F42B 39/14; F41H 11/28; B66C 3/16; B66C 3/04; B66C 3/18
USPC ..... 294/86.4, 106, 902; 86/50; 89/1.13
See application file for complete search history.

(56) References Cited

U.S. PATENT DOCUMENTS 1,990,673 A * 2/1935 Shaughnessy ..... 294/106
2,315,800 A 4/1943 Rochester et al.
(Continued)

FOREIGN PATENT DOCUMENTS

GR 1003895 B1 5/2002
WO WO-2005/090897 A1 9/2005

*Primary Examiner* — Paul T Chin
(74) *Attorney, Agent, or Firm* — Novak Druce Connolly Bove + Quigg LLP

(57) ABSTRACT

A mobile detonation-proof transport container designed for easier loading and unloading of detonation-dangerous objects is provided. The container is configured as an upright cylindrical container comprising a shell part, an open bottom part for the loading and unloading of detonation-dangerous objects in the container and a top part comprising a mounting plate having a bottom side and individually maneuverable gripping tools for the loading and unloading of detonation-dangerous objects in the container mounted on the bottom side of the mounting plate, wherein the individually maneuverable gripping tools comprise, firstly, vertical gripping tools for the maneuvering of detonation-dangerous objects in the vertical direction and, secondly, horizontal gripping tools for the maneuvering of detonation-dangerous objects in the horizontal plane. Also provided is a method for easier and safer handling in connection with the loading and unloading of detonation-dangerous objects in the container.

7 Claims, 4 Drawing Sheets

(51) Int. Cl.

| | |
|---|---|
| ***F41H 11/28*** | (2011.01) |
| ***F42B 39/14*** | (2006.01) |
| ***B66C 3/04*** | (2006.01) |
| ***B66C 3/16*** | (2006.01) |
| ***B66C 3/18*** | (2006.01) |

(56) References Cited

U.S. PATENT DOCUMENTS

| | | | | |
|---|---|---|---|---|
| 2,355,086 | A * | 8/1944 | Lang | 294/106 |
| 3,721,201 | A | 3/1973 | Boller | |
| 3,820,479 | A | 6/1974 | Fylling | |
| 3,929,366 | A * | 12/1975 | Keverline | 294/198 |
| 4,187,758 | A * | 2/1980 | Petty | 86/50 |
| 4,669,940 | A * | 6/1987 | Englehardt et al. | 294/106 |
| 5,209,537 | A * | 5/1993 | Smith et al. | 294/111 |
| 5,291,819 | A * | 3/1994 | Hambric | 89/1.13 |
| 5,398,983 | A * | 3/1995 | Ahrens | 294/106 |
| 5,443,294 | A * | 8/1995 | Prinz et al. | 294/68.23 |
| 5,570,920 | A | 11/1996 | Crisman et al. | |
| 5,639,201 | A * | 6/1997 | Curotto | 414/408 |
| 6,006,644 | A | 12/1999 | Matsuo et al. | |
| 7,347,657 | B2 * | 3/2008 | Brunn | 414/408 |
| 8,287,015 | B2 * | 10/2012 | Hawes | 294/86.4 |
| 2013/0014633 | A1 * | 1/2013 | Diaz | 89/1.13 |

* cited by examiner

MOBILE TRANSPORT CONTAINER FOR HANDLING OF DETONATION-DANGEROUS OBJECTS AND METHOD FOR THIS SAME

CROSS REFERENCE TO RELATED APPLICATIONS

This application is a National Phase filing under 35 U.S.C. §371 of PCT/SE2012/000038 filed on Mar. 21, 2012; and this application claims priority to application No. 1100207-8 filed in Sweden on Mar. 22, 2011, under 35 U.S.C. §119; the entire contents of all are hereby incorporated by reference.

The present invention relates to a mobile detonation-proof transport container designed for easier handling and transport of detonation-dangerous objects, and a method for this same.

PROBLEM DEFINITION AND BACKGROUND OF THE INVENTION

The invention is specifically intended for the handling of detonation-dangerous objects of the type home-made explosive devices, shells or mines, but can also relate to the handling of chemically and/or bacterialogically dangerous objects which potentially constitute a threat to the environment.

A growing problem in recent times has been the increasing use of explosive devices for terrorist purposes. The placement of explosive devices in towns and at airports, where many people are found, poses a high risk for the environment. In order to handle the problem, extensive intervention in the form of remote-controlled robots and detonation-proof containers is normally required, either by the explosive device being disabled directly on the spot, which calls for extensive barricades, or by the explosive device being placed in the detonation-proof container for transport to a safe place for subsequent disabling.

The use of explosive devices/mines in conflict zones also constitutes a growing problem, firstly for the civilian population, but also for civilian staff and civilian equipment involved in humanitarian operations in the conflict zone.

PRIOR ART

U.S. Pat. No. 3,820,479, 23 Feb. 1973, FIG. 6, discloses a mobile detonation-proof transport container, placed on a truck, for the handling and transport of detonation-dangerous objects to a safe place for subsequent destruction. The container is configured as an upright cylinder and is covered with a metal grille for pressure relief and for ventilation of detonation gases upon detonation. The container is also provided with an openable lid for the loading and unloading of detonation-dangerous objects.

U.S. Pat. No. 4,187,758, 12 Feb. 1980, FIGS. 3 and 4, also discloses a mobile detonation-proof transport container, placed on a truck, for the transport of explosive devices. The container, which is spherically configured and mounted on a pivotable arm, comprises a hatch which is opened and closed, under the influence of gravity, when the container is maneuvered/rotated forwards and backwards. The loading and unloading of explosive devices in the container is facilitated by the hatch being opened and closed automatically during the maneuvering of the container.

One problem with the said arrangements is, however, that the loading and unloading of detonation-dangerous objects in the container requires cooperation with some type of external manipulator or robot for loading and unloading, which is complicated and costly.

OBJECT OF THE INVENTION AND ITS DISTINGUISHING FEATURES

A main object of the present invention is a mobile detonation-proof transport container designed for easier handling in the loading and unloading of detonation-dangerous objects in the container.

A further object of the present invention is a simplified method for use in the loading and unloading of detonation-dangerous objects in a mobile detonation-proof transport container.

The said objects, as well as other objects which have not been enumerated here, are met in a satisfactory manner within the scope of that which is stated in the present independent patent claims. Embodiments of the invention are defined in the independent patent claims.

Thus, according to the present invention, a mobile detonation-proof transport container designed for easier loading and unloading of detonation-dangerous objects in the container has been provided.

Characteristic of transport containers is that one or more remote-controlled gripping tools are arranged inside the container for loading and unloading of detonation-dangerous objects in the transport container.

According to further aspects of the container according to the invention:

- the container is configured as an upright cylindrical container comprising a shell part, an open bottom part for the loading and unloading in the container, and a top part comprising a mounting plate on whose bottom side the individually maneuverable gripping tools are mounted,
- the container also comprises a raisable and lowerable inner part for controlling the distance between the vertical gripping tools and a detonation-dangerous object, depending on whether the object is located above or below the ground surface,
- the top part of the container comprises, firstly, a metal grille for the ventilation of overpressure and of detonation gases from a detonation in the container and, secondly, liquid-filled plastics bags for preventing the ejection of large and medium-sized parts to outside the container,
- the individually maneuverable gripping tools comprise, firstly, vertical gripping tools for the maneuvering of detonation-dangerous objects in the vertical direction and, secondly, horizontal gripping tools for the maneuvering of detonation-dangerous objects in the horizontal plane,
- the vertical gripping tools comprise two sets of mutually opposing fork-shaped gripping arms, in which each set of gripping arms is arranged rotatably on two horizontal drive shafts in a bearing housing in the top part of the container 1, wherein the gripping arms are arranged parallelly to one another via transverse stays,
- the horizontal gripping tools comprise four rectangularly or squarely shaped grilles vertically arranged on vertical raisable and lowerable drive shafts inside the container, wherein the grilles are arranged rotatably in the horizontal plane,
- the vertical gripping tools comprise buckets for the collection of detonation-dangerous objects which are in liquid and/or powder form,
- the horizontal pivotable gripping tools 19 comprise hinged plates on the bottom side of the gripping tools 19 for the collection of detonation-dangerous objects 2 which hang loosely together and are at risk of falling apart during the loading process.

According to the present invention, a simplified method for loading and unloading detonation-dangerous objects has also been provided.

Characteristic of the method is that the loading and unloading of detonation-dangerous objects 2 in the container 1 is effected via the maneuvering of individually maneuverable gripping tools 6, 19 arranged inside the container 1.

According to further aspects of the method according to the invention:

the transport container is configured as an upright cylindrical container having an open bottom part, and the loading and unloading of detonation-dangerous objects is effected via the open bottom part of the container.

ADVANTAGES AND EFFECTS OF THE INVENTION

The present invention now offers a simpler and safer method for handling detonation-dangerous objects in a mobile detonation-proof transport container, by virtue of the fact that gripping tools for the loading and unloading of objects in the container are arranged inside the container.

That which is especially novel with the container according to the invention is the manner in which the loading and unloading of detonation-dangerous objects is done via the bottom opening in the container.

The fact that gripping tools for loading and unloading are arranged inside the container and configured to, by remote control, grip objects which are located under the container on the ground surface or directly below the ground surface means that no further external manipulators or robots for loading and unloading objects in the container are required.

From the above-stated, it will probably be clearly apparent that all activities associated with the handling of detonation-dangerous objects via the container according to the invention can be carried out without difficulty by remote control behind secure protection. The container according to the invention thus fulfils all the requirements which might be placed upon containers of the type referred to here.

An important advantage of the container according to the invention is that, since the container comprises gripping tools for the loading and unloading of objects, accessibility, and thus the number of possible fields of application, is increased. For example, the container with gripping tools can be suspended from a crane arm and lowered down into poorly accessible spaces which are not normally accessible to containers in which external robots are required for the loading of objects.

The fact that the gripping tools are also configured for digging function makes it possible to gather in and load objects located below the ground surface, for example mines.

The gripping tools can also be configured to collect liquid or powdery explosive materials.

A further advantage according to the invention is the absence of a hatch on the container, which simplifies the method used in the loading and unloading of objects.

Further advantages and effects will emerge from a study and consideration of the following, detailed description of the invention, including one of its advantageous embodiments, the patent claims and the accompanying drawing figures.

LIST OF FIGURES

The invention has been defined in the following patent claims and will now be described only somewhat further in connection with the appended figures, in which:

DETAILED DESCRIPTION OF EMBODIMENTS

In the various figures, corresponding parts have been given the same reference notations irrespective of the scales of the figures.

Figure 1:
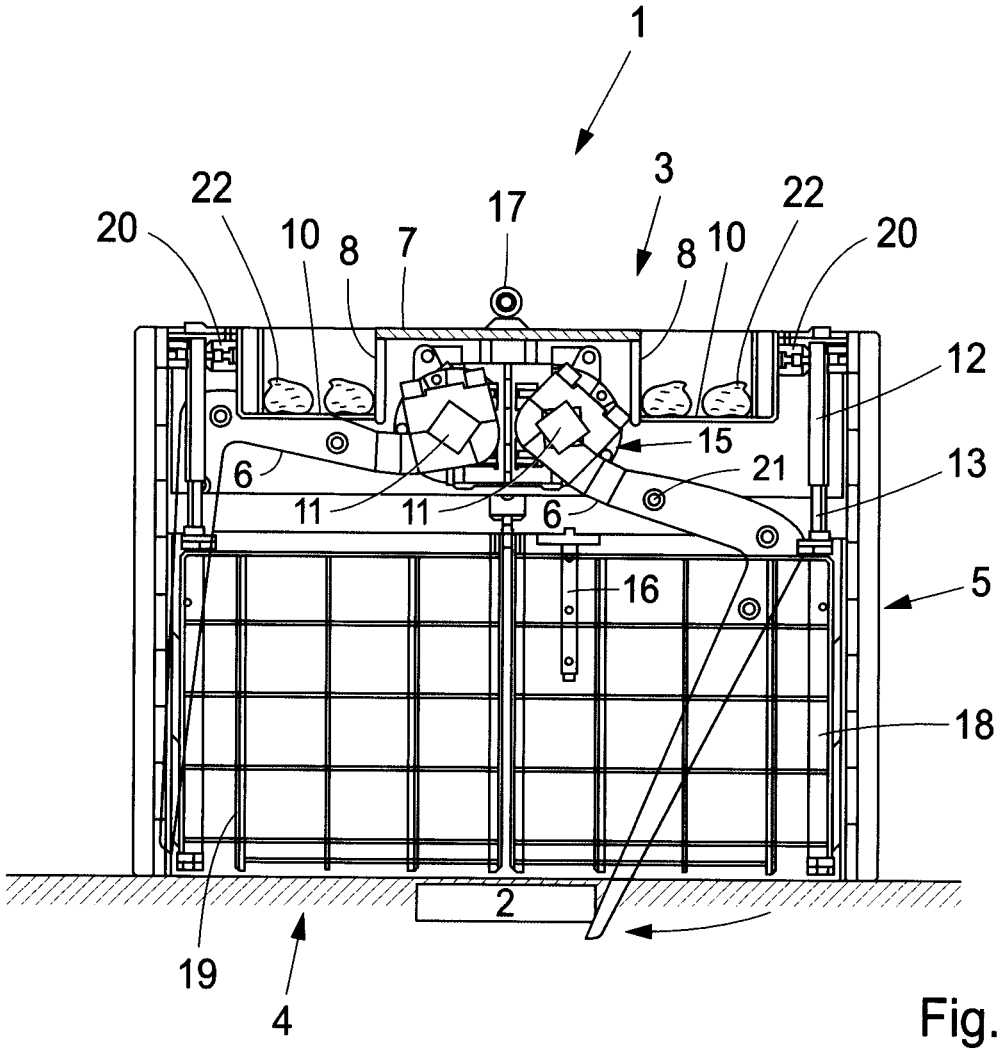
FIG. 1 shows schematically a side projection of a mobile detonation-proof transport container comprising gripping tools and a raisable and lowerable inner part.
Figure 2:
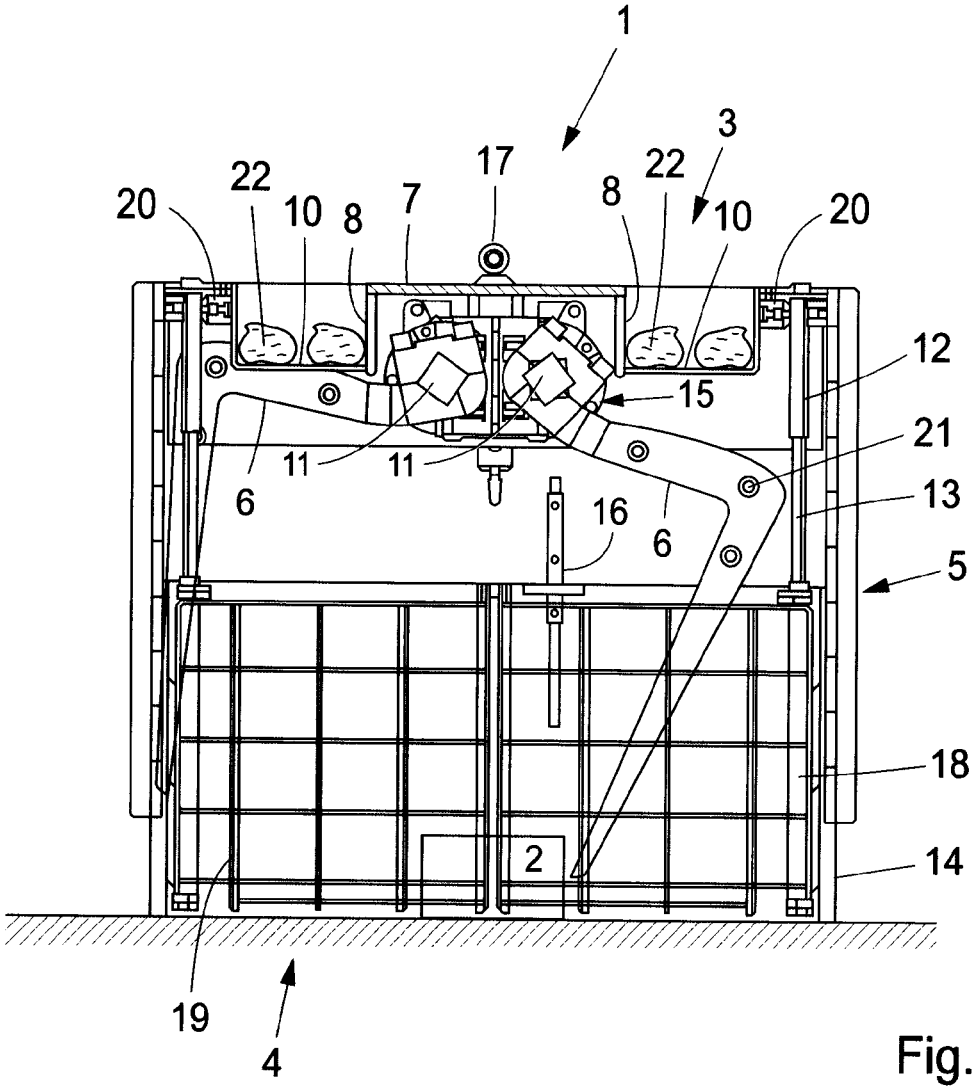
FIG. 2 shows schematically a detonation-proof transport container according to FIG. 1, in which the raisable and lowerable inner part is in the lowered position.

The detonation-proof transport container 1 according to FIGS. 1 and 2 is configured as an upright cylindrical container having a cylindrical shell part 5, an open bottom part 4 and a partially open top part 3. The container 1 comprises a raisable and lowerable inner part 14, a first set of gripping tools, referred to as the vertical gripping tools 6, and a second set of gripping tools, referred to as the horizontal gripping tools 19. FIG. 1 and FIG. 2 show the raisable and lowerable inner part 14 in its upper and lower position respectively.

The vertical gripping tools 6 comprise two mutually opposing sets of fork-shaped gripping arms, in which each set of fork-shaped gripping arms is arranged rotatably in the vertical direction on two horizontally arranged drive shafts 11 in a bearing housing 15 in the top part 3 of the container 1, which are arranged parallelly to one another via transverse stays 21. As can further be seen from FIGS. 3, 4, the number of fork-shaped gripping arms on each drive shaft 11 is three, but can be more or fewer. Each one of the drive shafts 11 is connected to a drive or rotating mechanism in the bearing housing 15. The drive mechanisms of the drive shafts 11 can be of the chain or gearwheel type and are controlled, preferably, independently of each other. The drive mechanisms are driven, preferably, electrically via an electric motor, but can also be driven via compressed air or some other drive source. To the drive mechanisms 20 are also connected one or more remote control mechanisms (not shown).

Figure 3:
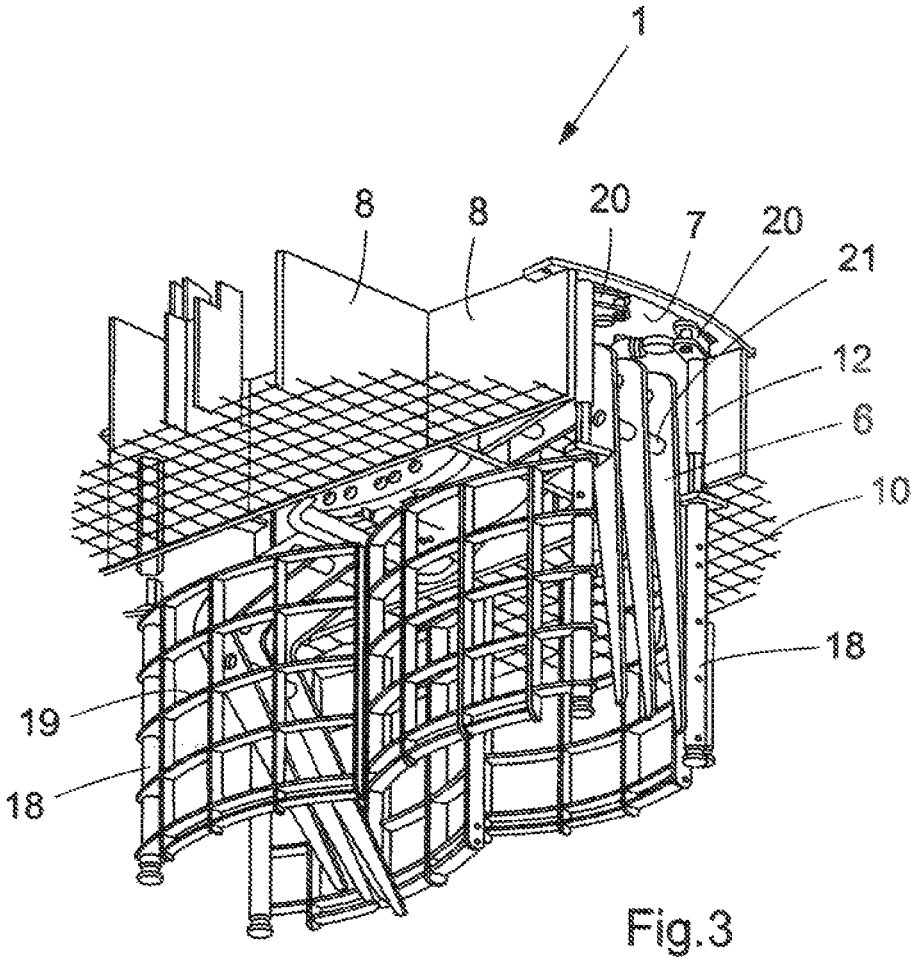
FIG. 3 shows schematically an oblique projection of a detonation-proof transport container according to FIG. 1, in which the arrangement of horizontal and vertical gripping tools can be seen.

The horizontal gripping tools 19 comprise four rectangularly or squarely shaped grilles or plates arranged in pairs inside the container 1, according to FIG. 3.

The gripping tools 19, which, preferably, are slightly curved or arched for good gripping function, are rotatably or pivotably arranged on vertically arranged raisable and lowerable drive shafts 18 arranged parallelly to one another. The raisable and lowerable drive shafts 18 are connected, firstly, to a common rotating mechanism 20 for synchronized rotation of the grille-like gripping tools 19 in the horizontal plane and, secondly, to a common lifting mechanism 12 for synchronized lifting or lowering of the gripping tools 19. On the raisable and lowerable drive shafts 18 is also mounted the raisable and lowerable inner part 14.

In an alternative embodiment, the raisable and lowerable inner part 14 is mounted on a separate lifting mechanism 12 for independent lifting or lowering of the inner part 14.

In another alternative embodiment, the common rotating mechanism 20 for the gripping tools 19 is replaced with individually operable rotating mechanisms (not shown). The common rotating mechanism 20 and the lifting mechanism 12 are, preferably, electrically driven via electric motors, but can also be driven with compressed air or some other drive source. In addition, the rotating mechanism 20 and the lifting mechanism 12 are connected to a remote control mechanism for remote-controlled maneuvering of the gripping tools 19 and the inner part 14.

In FIG. 3, the vertical and the horizontal gripping tools 6, 19 are shown mounted with their respective drive mechanisms 20, 21 in the top part 3 of the container 1, obliquely from below. As can be seen from FIG. 3, the top part 3 of the container 1 is partially covered by a mounting plate 7. On the bottom side of the mounting plate 7 are mounted the bearing housing 15 with drive shafts 11 and drive mechanisms for the vertical gripping tools 6, as well as rotating mechanisms 20 and lifting mechanisms 12 for the horizontal gripping tools 19.

The mounting plate 7 is mounted on the top part 3 of the container 1 via the shell 5 and via vertically arranged supporting plates 8, preferably via welding and/or screw/bolt connection.

The other part of the top part 3 of the container 1 is covered with a metal grille 10, mounted on the vertical supporting plates 8 and on the inner part of the shell 5 of the container 1. The function of the grille 8 is to ventilate overpressure and detonation gases from any detonation in the container 1. On parts of the grille 10 is also arranged damming material 22, such as, for example, sandbags or liquid-filled plastics bags, FIGS. 1 and 2, to prevent large or medium-sized parts/fragments from the detonation from being scattered outside the container 1.

As can further be seen from FIG. 1 and FIG. 2, a fastening device 17 is arranged on the top part 3 of the mounting plate 7 for suspension of the transport container 1 in a mobile crane, telpher, or for mounting on a control arm for maneuvering the container 1 relative to a detonation-dangerous object 2. The fastening device 17 can be of the type hook, eyelet, screw, bolt or snap fastening.

Figure 4:
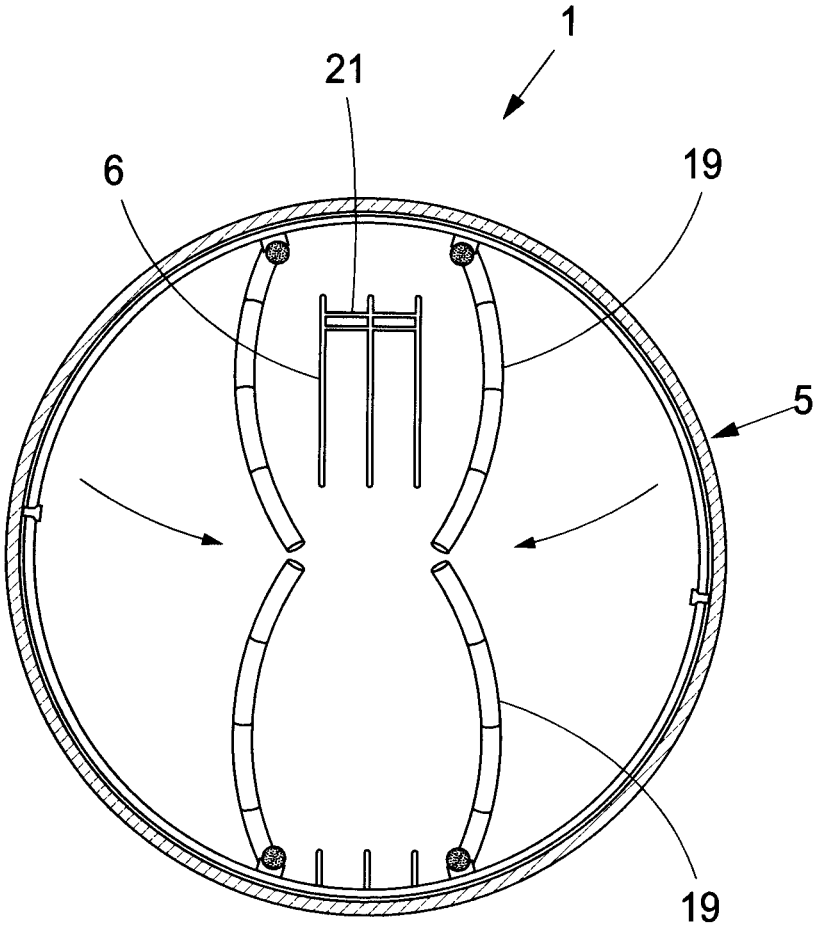
FIG. 4 shows schematically a projection from below of a detonation-proof transport container according to FIG. 1, in which interaction of the horizontal and vertical gripping tools can be seen.

After the transport container 1 has been maneuvered, remote-controlled, into the correct position above the detonation-dangerous object 2, the transport container is lowered down over the object 2, after which the vertical and horizontal gripping tools 6, 19 are maneuvered by remote control and coordinated such that the detonation-dangerous object can be gripped and loaded in the transport container 1 via the open bottom part 4, FIGS. 1, 2 and 4.

Depending on whether the detonation-dangerous object 2 is located visibly directly on the ground or below the ground surface, the raisable and lowerable inner part 14 can be used.

If the object 2 is located on the ground surface, the inner part 14 is locked, via a locking mechanism 16, in its lower position, FIG. 1, after which the transport container 1 is lowered so that it ends up on the ground surface over the detonation-dangerous object 2, whereupon the gripping tools 6, 19 are maneuvered such that the object 2 is gripped and loaded into the container 1 via the open bottom part 4. The fact that the range of the vertical gripping tools 6, in the vertical direction, is matched to the height of the container 1 when the inner part 14 is in its lower position allows the vertical gripping tools 6 to operate above the ground surface without being hampered by the ground.

If the object 2 is located below the ground surface, the inner part 14 is locked in the wholly or partially elevated position, which enables digging function and the possibility of accessing detonation-dangerous objects 2, for example mines, below the ground surface. The vertical gripping tools 6 are thus configured to access objects 2 which are located below the ground surface or objects 2 which are covered by, for example, stones/boulders or are otherwise concealed.

In a further embodiment (not shown), the fork-like gripping tools 6 are exchanged for bucket-like or shovel-like collecting tools for enabling the collection of explosive objects 2 which are in liquid or powder form. In the said embodiment comprising bucket-like or shovel-like collecting tools, an extra collecting container can also be arranged inside the transport container 1, for the storage of liquid or powdery objects 2 inside the container 1.

In a further alternative embodiment, the horizontal pivotable gripping tools 19 can also be supplemented by hinged plates or grilles on the bottom side of the gripping tools 19 for the collection of loosely connected objects 2 which are at risk of falling apart during the loading process.

The invention is not limited to the shown embodiments, but can be varied in different ways within the scope of the patent claims.

The invention claimed is:

1. Mobile detonation-proof transport container designed for easier loading and unloading of detonation-dangerous objects, wherein the container is configured as an upright cylindrical container comprising a shell part, an open bottom part for the loading and unloading of detonation-dangerous objects in the container and a top part comprising a metal grille for the ventilation of overpressure and of detonation gases from a detonation in the container and a mounting plate having a bottom side and individually maneuverable gripping tools for the loading and unloading of detonation-dangerous objects in the container mounted on the bottom side of the mounting plate, wherein the individually maneuverable gripping tools comprise, firstly, vertical gripping tools for the maneuvering of detonation-dangerous objects in the vertical direction and, secondly, horizontal gripping tools for the maneuvering of detonation-dangerous objects in the horizontal plane.

2. Mobile detonation-proof transport container according to claim 1, wherein the container also comprises a raisable and lowerable inner part for controlling the distance between the vertical gripping tools and a detonation-dangerous object, depending on whether the object is located above or below the ground surface.

3. Mobile detonation-proof transport container according to claim 1, wherein the top part of the container further comprises liquid-filled plastics bags for preventing the ejection of large and medium-sized parts to outside the container.

4. Mobile detonation-proof transport container according to claim 1, wherein the vertical gripping tools comprise two mutually opposing sets of fork-shaped gripping arms, in which each set of fork-shaped gripping arms is arranged rotatably on two horizontal drive shafts in a bearing housing in the top part of the container, wherein the gripping arms are arranged parallelly to one another via transverse stays.

5. Mobile detonation-proof transport container according to claim 1, wherein the horizontal gripping tools comprise four rectangularly or squarely shaped grilles vertically arranged on vertical raisable and lowerable drive shafts inside the container, wherein the grilles are arranged rotatably in the horizontal plane.

6. Mobile detonation-proof transport container according to claim 1, wherein the vertical gripping tools comprise buckets for the collection of detonation-dangerous objects which are in liquid and/or powder form.

7. Mobile detonation-proof transport container according to claim 1, wherein the horizontal pivotable gripping tools comprise hinged plates on the bottom side of the gripping tools for the collection of detonation-dangerous objects which are loosely connected and are at risk of falling apart during the loading process.

* * * * *